US007726633B2

(12) United States Patent
Cook et al.

(10) Patent No.: US 7,726,633 B2
(45) Date of Patent: Jun. 1, 2010

(54) PLASTIC FENCE

(75) Inventors: John H. Cook, York, PA (US); Stephen D. Hatcher, Dillsburg, PA (US)

(73) Assignee: Ames True Temper, Inc., Camp Hill, PA (US)

( * ) Notice: Subject to any disclaimer, the term of this patent is extended or adjusted under 35 U.S.C. 154(b) by 163 days.

(21) Appl. No.: 12/049,409

(22) Filed: Mar. 17, 2008

(65) Prior Publication Data

US 2009/0230371 A1 Sep. 17, 2009

(51) Int. Cl.
*E04H 17/14* (2006.01)

(52) U.S. Cl. ..... 256/19; 256/22; 256/23

(58) Field of Classification Search ..... 256/19, 256/22, 23

See application file for complete search history.

(56) References Cited

U.S. PATENT DOCUMENTS

| | | | | | |
|---|---|---|---|---|---|
| 2,876,874 | A * | 3/1959 | Benham | D25/48 |
| 4,035,978 | A * | 7/1977 | Bajorek et al. | 256/21 |
| 5,931,449 | A * | 8/1999 | Gwaltney | 256/24 |
| 5,992,124 | A * | 11/1999 | Robinson | 52/834 |
| 6,374,560 | B1 * | 4/2002 | Schiedegger et al. | 256/19 |
| 6,634,154 | B1 * | 10/2003 | Palencar | 256/22 |
| 6,637,728 | B2 * | 10/2003 | Pettit et al. | 256/19 |
| 6,688,583 | B2 * | 2/2004 | Merrick | 256/19 |
| D512,522 | S * | 12/2005 | Stein et al. | D25/164 |
| D535,405 | S * | 1/2007 | Stein et al. | D25/38 |
| 7,419,141 | B2 * | 9/2008 | Wall | 256/24 |
| D579,574 | S * | 10/2008 | Cook et al. | D25/42 |
| 2002/0000545 | A1 * | 1/2002 | Pettit et al. | 256/19 |

* cited by examiner

*Primary Examiner*—Victor MacArthur
(74) *Attorney, Agent, or Firm*—Eckert Seamans Cherin & Mellott, LLC; David C. Jenkins, Esq.

(57) ABSTRACT

A molded plastic fence having a unitary front fence section and a unitary rear fence section is provided. The unitary front fence section and the unitary rear fence section are coupled together to form a fence without visible molding artifacts. To emulate a traditional wooden fence, the fence sections preferably include various fence elements such as posts, slats and rails. The fence elements on each fence section typically have a planar member with an inner side and a raised edge extending from the inner side. The molding artifacts are disposed on the inner sides of the fence elements. The unitary front fence section and a unitary rear fence section are coupled with the raised edges engaging each other. In this configuration the molding artifacts are hidden from view and the fence elements appear as solid.

14 Claims, 4 Drawing Sheets

PLASTIC FENCE

BACKGROUND OF THE INVENTION

1. Field of the Invention

This invention relates to molded plastic fences and, more specifically, to a molded plastic fence having both a front section and a rear section each having an inner side, wherein all molding artifacts, e.g. ribs, ejection pin marks, etc., are disposed on the front and rear fence section inner sides, and wherein the front and rear fence sections are joined together and enclose the inner sides whereby a visually sealed fence section is created.

2. Background Information

Plastic fences are used in many locations for decorative fences. Such decorative fences were originally assembled from wood. Wooden fences had the advantage of being generally uniform on both the front and back sides and were, therefore, visually pleasing. Wooden fences, however, were also expensive, heavy, and subject to degrading when exposed to weather. Plastic fences could be molded, generally, into the shape of wooden fences and were inexpensive, light, and weather resistant. Plastic fences, however, included molding artifacts, e.g. ribs, ejection pin marks, etc., which were visually unattractive.

Such molding artifacts were generally placed on the "back" side of the plastic fence in an attempt to keep the molding artifacts hidden from view. While molding artifacts on the rear side of a fence could not be seen from the front, such molding artifacts were still clearly visible when an observer moved to the side of the fence. In an attempt to further hide the molding artifacts, fence elements, e.g. posts, slats and rails, were molded as deep C-shaped channels wherein the molding artifacts were disposed at the bottom of the channel. This shape helped hide the molding artifacts from observers standing to the side of such fences. However, observers behind such deep channel fences, e.g. a person in a yard looking at such fences lining a sidewalk, could still see the molding artifacts in the deep channels. Further, the fact that the fence elements can be observed as not being solid further detracts from the fence's attractiveness.

SUMMARY OF THE INVENTION

The disadvantages of the prior art are overcome by the concept embodied in the claims set forth below. The concept provides for a molded plastic fence having a unitary front fence section and a unitary rear fence section which are coupled together to form a fence without visible internal molding artifacts. To emulate a traditional wooden fence, the fence sections preferably include various fence elements such as posts, slats and rails. The fence elements on each fence section typically have a planar member with an inner side and a raised edge extending from the inner side. The molding artifacts are disposed on the inner sides of the fence elements. The unitary front fence section and a unitary rear fence section are coupled with the raised edges engaging each other. In this configuration the interior molding artifacts are hidden from view and the fence elements appear as solid. Preferably, substantially all molding artifacts are disposed on the inner side of the fence sections and the external surface of the fence assembly are substantially free from molding artifacts. A fence in this configuration has the advantages of both a wooden fence and a plastic fence.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

As used herein, "coupled" means a link between two or more elements, whether direct or indirect, so long as a link occurs.

As used herein, "directly coupled" means that two elements are directly in contact with each other.

As used herein, "fixedly coupled" or "fixed" means that two components are so coupled to move as one.

As used herein, the word "unitary" means a component is created as a single piece or unit. That is, a component that includes pieces that are created separately and then coupled together as a unit is not a "unitary" component or body.

Figure 1:
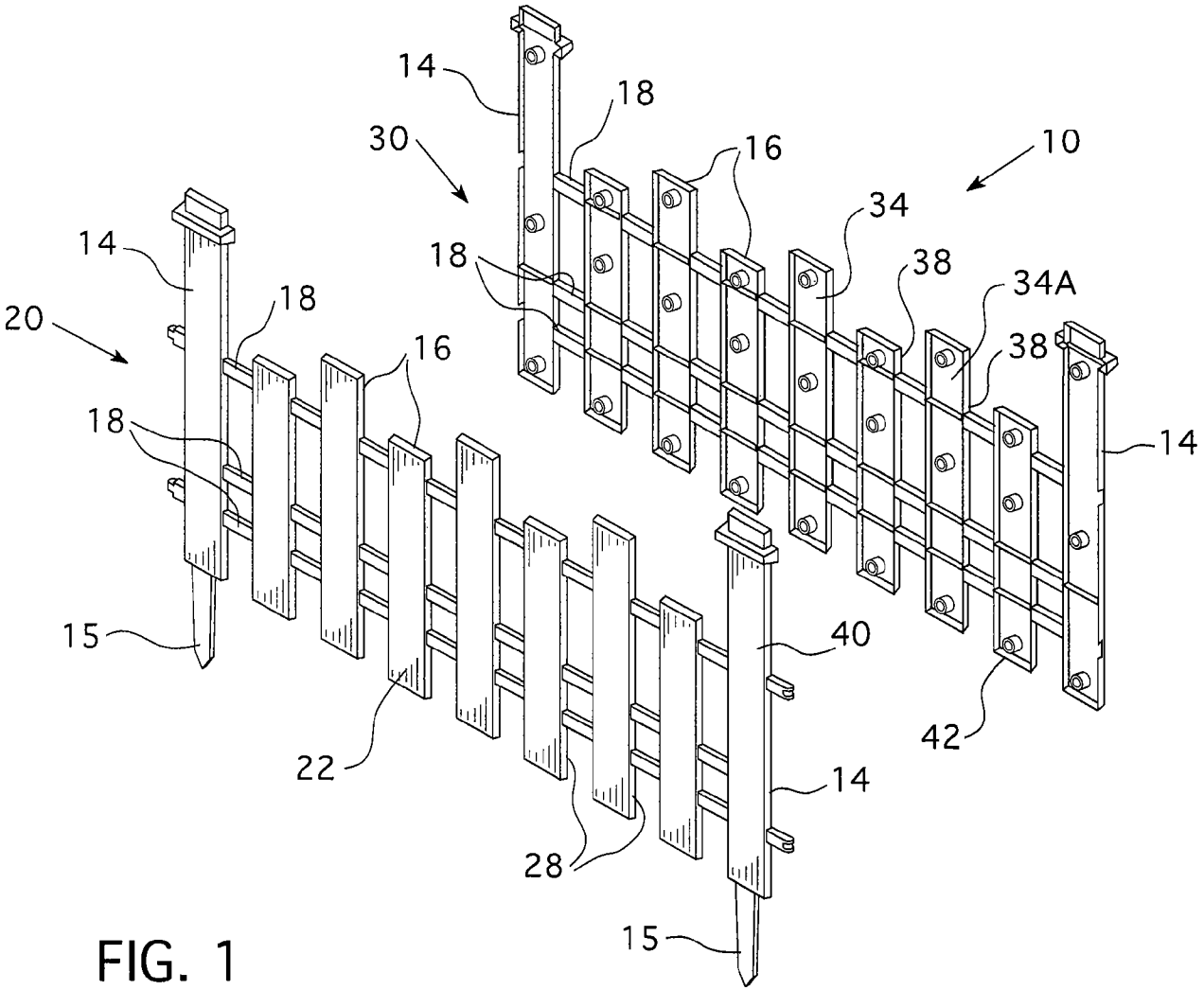
FIG. 1 is a front view of an exploded fence assembly.

As shown in FIG. 1, a molded plastic fence assembly 10 includes a number of fence elements 12. As shown, the fence elements 12 include posts 14, slats 16 and rails 18 that are generally vertical or horizontal elements that extend generally perpendicular to each other. It is understood that the fence elements 12 may have other shapes, such as, but not limited to, curved (not shown), and/or other orientations, such as, but not limited to, angled, as in a lattice (not shown). The posts 14 may include spikes 15 structured to be disposed in the ground and thereby hold the fence assembly 10 upright. As the spikes 15 are to be buried and not generally visible, the spikes are not fence elements. The fence assembly 10 may be joined with other fences (not shown) to become an elongated fence. The molded plastic fence assembly 10 is created when a unitary front fence section 20 and a unitary rear fence section 30 are coupled together.

Figure 2:
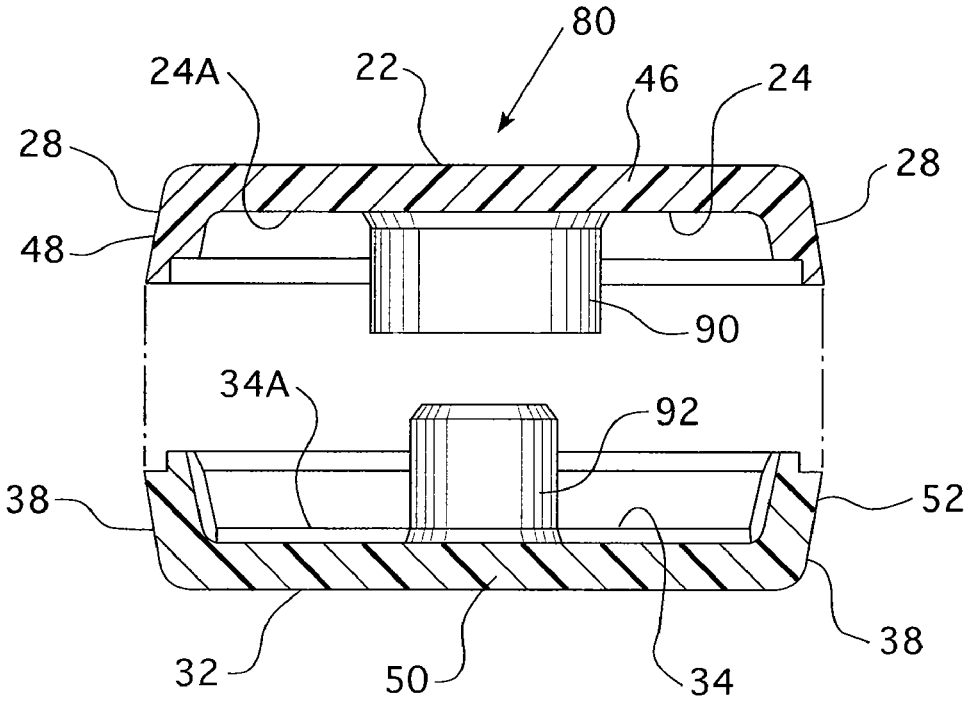
FIG. 2 is a cross-sectional view of a fence element wherein the fence sections are separated.
Figure 3:
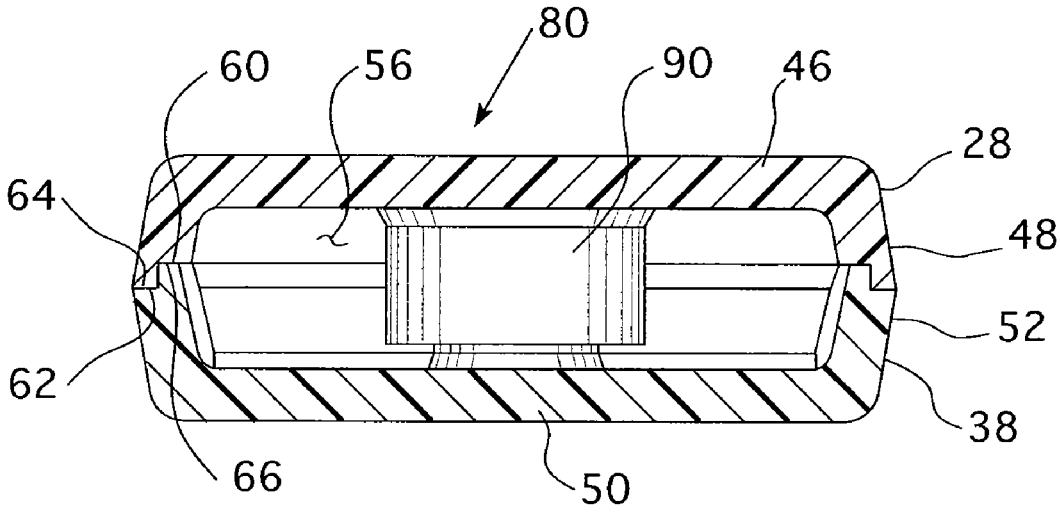
FIG. 3 is a cross-sectional view of a fence element wherein the fence sections coupled.

As shown in FIGS. 2 and 3, the unitary front fence section 20 has forward side 22, an inner side 24, a plurality of partial fence elements 26. The unitary front fence section partial fence elements 26 each have lateral sides 28. When the fence elements 12 have generally orthogonal cross-sections (as shown), the unitary front fence section fence element lateral sides 28 are generally perpendicular to the unitary front fence section forward side 22. If the fence elements 12 have a curved or rounded shape (not shown), the front fence section fence element lateral sides 28 may be considered to begin at a location about 45 degrees from an axis extending normal to the plane of the fence assembly 10. The unitary front fence section inner side 24 may have one or more interior molding artifacts disposed thereon. The unitary front fence section forward side 22 and front fence section fence element lateral sides 28 are generally, or entirely, free from molding artifacts.

The unitary rear fence section 30 has a back side 32, an inner side 34, and a plurality of partial fence elements 36. The unitary rear fence section partial fence elements 26 each have lateral sides 38. The unitary rear fence section back side 32 and rear fence section fence element lateral sides 38 are generally, or entirely, free from molding artifacts. The unitary rear fence section inner side 34 may have one or more interior molding artifacts disposed thereon. When the unitary front fence section 20 and the unitary rear fence section 30 are coupled together the unitary front fence section partial fence elements 26 and the unitary rear fence section partial fence elements 36 form the fence elements 12 and also define an enclosed space 56, discussed below. In this configuration, because all interior molding artifacts are disposed on the unitary front fence section inner side 24 and the unitary rear fence section inner side 34, that is, in the interior space, no interior molding artifacts are visible.

Preferably, each element in the unitary front fence section plurality of partial fence elements 26 includes a substantially contiguous perimeter 40. Similarly, each element in the unitary rear fence section plurality of partial fence elements 36 includes a substantially contiguous perimeter 42. The unitary front fence section plurality of partial fence elements substantially contiguous perimeter 40 is structured to engage the unitary rear fence section plurality of partial fence elements substantially contiguous perimeter 42.

More preferably, each element in said unitary front fence section plurality of partial fence elements 26 includes a generally planar member 46 having a raised edge 48. The unitary front fence section plurality of partial fence elements raised edge 48 extends along the substantially contiguous perimeter 40 of each element in the unitary front fence section plurality of partial fence elements 26. The unitary front fence section plurality of partial fence elements raised edge 48 extends from the unitary front fence section inner side 24. Similarly, each element in the unitary rear fence section plurality of partial fence elements 36 includes a generally planar member 50 having a raised edge 52. The unitary rear fence section plurality of partial fence elements raised edge 52 extends along the unitary rear fence section plurality of partial fence elements substantially contiguous perimeter 42. The unitary rear fence section plurality of partial fence elements raised edge 52 extends from the unitary rear fence section inner side 34. Further, each planar member 46, 50 has an inner side 24A, 34A corresponding to the unitary front fence section inner side 24 and the unitary rear fence section inner side 34, respectively.

In this configuration, the coupling of the unitary front fence section 20 and a unitary rear fence section 30 create an enclosed space 56 within selected fence elements 12. That is, selected fence elements 12 such as, but not limited to the posts 14 and slats 16 are, in a wooden fence, thicker than other elements such as the rails 18.

Figure 2A:
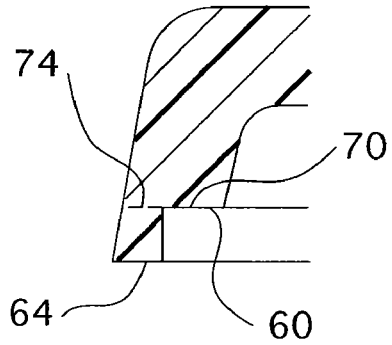
Figure 2B:
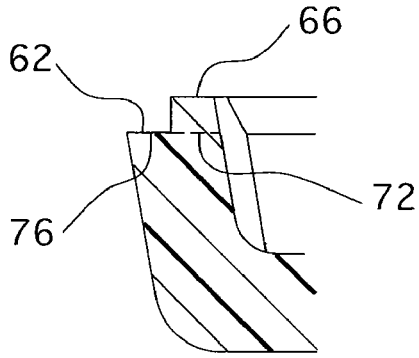

As shown in FIGS. 2A and 2B, in a more preferred embodiment, each element in the unitary front fence section plurality of partial fence elements raised edge 48 and in the unitary rear fence section plurality of partial fence elements raised edge 52 includes an extended rib 64, 66 that cooperatively engages and corresponds to each other. That is, each of the unitary front fence section plurality of partial fence elements raised edge 48 and each of the unitary rear fence section plurality of partial fence elements raised edge 52 have a face 60, 62. Each unitary front fence section plurality of partial fence elements raised edge face 60 and each unitary rear fence section plurality of partial fence elements raised edge face 62, preferably, extends generally parallel to the associated planar member inner sides 24A, 34A. Each unitary front fence section plurality of partial fence elements raised edge face 60 and each unitary rear fence section plurality of partial fence elements raised edge face 62 have a width. Each of the unitary front fence section plurality of partial fence elements raised edge face 60 and each of the unitary rear fence section plurality of partial fence elements raised edge face 62 further includes an extended rib 64, 66. Each unitary front fence section plurality of partial fence elements raised edge extended rib 64 and each unitary rear fence section plurality of partial fence elements raised edge extended rib 66, have a width that is less than the width of the associated face 60, 62. Each unitary front fence section plurality of partial fence elements raised edge extended rib 64 and each unitary rear fence section plurality of partial fence elements raised edge extended rib 66 are not aligned with each other. Thus, when the unitary front fence section 20 and a unitary rear fence section 30 are coupled, each of the unitary front fence section plurality of partial fence elements raised edge extended rib 64 engages the unitary rear fence section plurality of partial fence elements raised edge face 62 and, conversely, each unitary rear fence section plurality of partial fence elements raised edge extended rib 66 engages the unitary front fence section plurality of partial fence elements raised edge face 60.

Preferably, each unitary front fence section plurality of partial fence elements raised edge extended rib 64 and each unitary rear fence section plurality of partial fence elements raised edge extended rib 66 each have a width that is about half the width of the edge face 60, 62 from which each said rib 64, 66 extends. More preferably, the unitary front fence section plurality of partial fence elements raised edge face 60 and the unitary rear fence section plurality of partial fence elements raised edge face 62 each have an inner portion 70, 72 and an outer portion 74, 76, respectively. In this configuration, each of the unitary front fence section plurality of partial fence elements raised edge extended rib 64 extends from the unitary front fence section plurality of partial fence elements raised edge face outer portion 74. Conversely, each of the unitary rear fence section plurality of partial fence elements raised edge extended rib 66 extends from the unitary rear fence section plurality of partial fence elements raised edge face inner portion 72.

Figure 4:
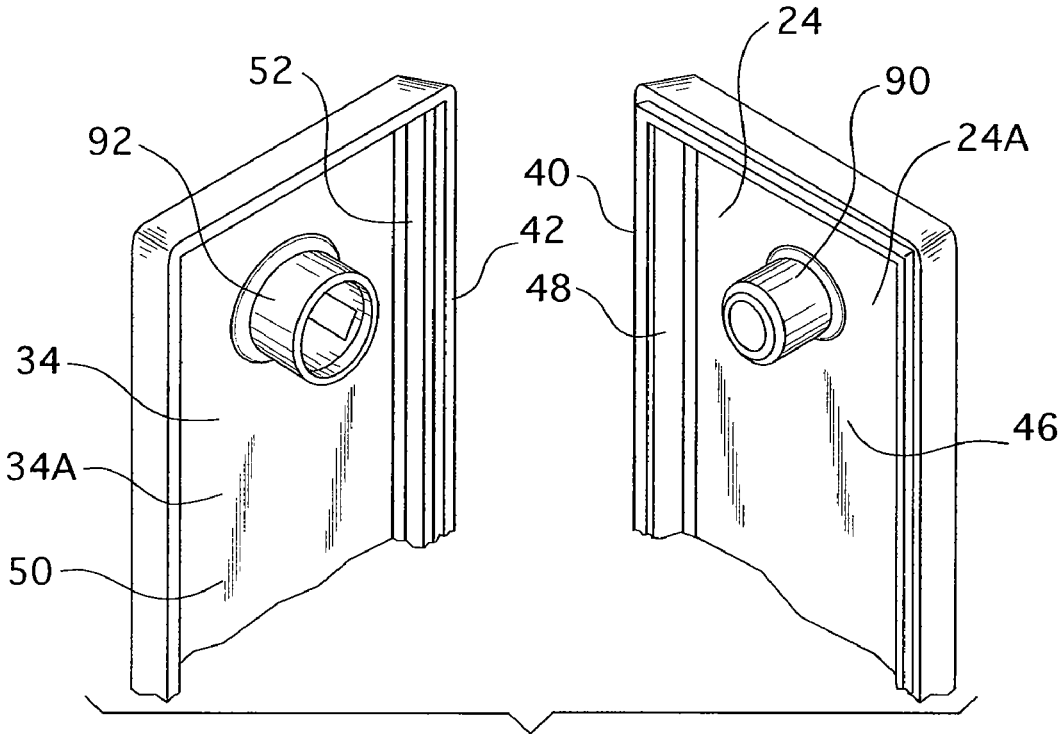
FIG. 4 is an isometric view of a fence element wherein the fence sections are separated.
Figure 5:
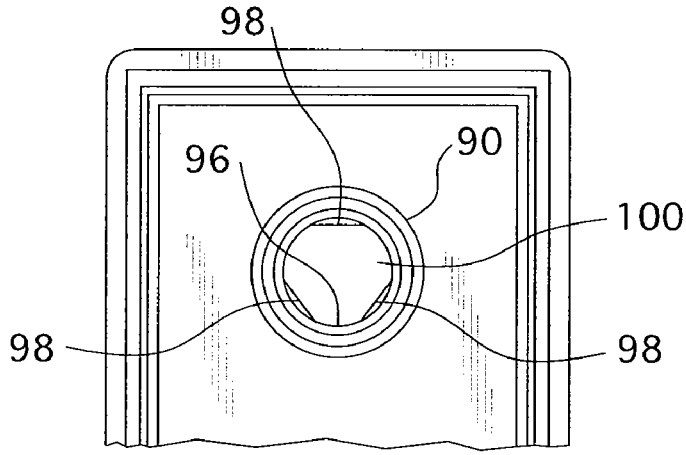
FIG. 5 is a view of the inner side of a fence element showing part of a coupling device.

As shown in FIGS. 4 and 5, the fence assembly 10 further includes a coupling device 80 structured to couple the unitary front fence section 20 and the unitary rear fence section 30. That is, the coupling device 80 includes a first component 82 and a second component 84 disposed on the unitary front fence section 20 and the unitary rear fence section 30, respectively. Preferably, the unitary front fence section coupling device first component 82 is disposed on at least one of the unitary front fence section plurality of partial fence elements planar member inner side 24A. The unitary rear fence section coupling device second component 84 is disposed on at least one of the unitary rear fence section plurality of partial fence elements planar member inner side 34A.

The coupling device 80 may include, for example, a coupling device first component 82 that is a generally circular collar 90 and a coupling device second component 84 that is a generally circular peg 92. The peg 92 is structured to fit snuggly within the collar 90. Preferably, the collar 90 has an inner surface 96 having at least one flat portion 98 that is structured to act as a wedge. More preferably, there are three flat portions 98A, 98B, 98C on the collar inner surface 96. The center of each flat portion 98A, 98B, 98C is disposed about 120 degrees apart about the collar inner surface 96. The coupling device 80 may also include an adhesive 100 disposed between the unitary front fence section 20 and the unitary rear fence section 30. The adhesive 100 may, for example, be disposed within each collar 92 so that the collar 92 bonds to an associated peg 90.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A molded plastic fence assembly comprising:

a unitary front fence half section of homogenous construction having a forward side and an inner side, said forward and inner sides defining a plurality of partial fence elements including a plurality of vertical picket front halves, a plurality of horizontal rail front halves, and a plurality of vertical post front halves, said inner side having a plurality of cylindrical pegs protruding inwardly therefrom;

a unitary rear fence half section of homogenous construction having a back side and an inner side, said back and inner sides defining a plurality of partial fence elements including a plurality of vertical picket back halves, a plurality of horizontal rail back halves, and a plurality of vertical post back halves, said inner side having a plurality of cylindrical collars protruding inwardly therefrom, each of said cylindrical collars having a substantially cylindrical inner surface having three flat portions radially disposed about 120 degrees apart; and said front fence section and said rear fence section each having a perimeter end face, said end faces structured to engage each other contiguously to define a hollow interior in communication within said inner sides, said pegs received and adhesively bonded within said collars and wedged against said flat portions.

2. The molded plastic fence assembly of claim 1 wherein:

each said element in said unitary front fence section plurality of partial fence elements includes a substantially contiguous perimeter;

each said element in said unitary rear fence section plurality of partial fence elements includes a substantially contiguous perimeter; and the substantially contiguous perimeter of each said element in said unitary front fence section plurality of partial fence elements being structured to engage the substantially contiguous perimeter of each said element in said unitary rear fence section plurality of partial fence elements.

3. The molded plastic fence assembly of claim 2 wherein:

each said element in said unitary front fence section plurality of partial fence elements includes a generally planar member having a raised edge, said raised edge extending along the substantially contiguous perimeter of each said element in said unitary front fence section plurality of partial fence elements, said edge extending from said inner side; and each said element in said unitary rear fence section plurality of partial fence elements includes a generally planar member having a raised edge, said raised edge extending along the substantially contiguous perimeter of each said element in said unitary rear fence section plurality of partial fence elements, said edge extending from said inner side.

4. The molded plastic fence assembly of claim 3 wherein:

each said raised edge in said unitary front fence section plurality of partial fence elements has a width and a face and includes an extended rib, said rib having a width that is less than the width of said associated edge, said rib extending from said edge face;

each said raised edge in said unitary rear fence section plurality of partial fence elements has a width and a face and includes an extended rib, said rib having a width that is less than the width of said associated edge, said rib extending from said edge face; and wherein each said rib on said unitary front fence section plurality of partial fence elements does not align with a said rib on said unitary rear fence section plurality of partial fence elements.

5. The molded plastic fence assembly of claim 4 wherein:

wherein each said rib on said unitary front fence section plurality of partial fence elements has a width that is about half the width of the edge face from which each said rib extends; and wherein each said rib on said unitary rear fence section plurality of partial fence elements has a width that is about half the width of the edge face from which each said rib extends.

6. The molded plastic fence assembly of claim 5 wherein:

wherein each said raised edge face in said unitary front fence section plurality of partial fence elements has an inner portion and an outer portion;

wherein each said rib on said unitary front fence section plurality of partial fence elements extends from the outer portion of the associated edge face;

wherein each said raised edge face in said unitary rear fence section plurality of partial fence elements has an inner portion and an outer portion; and wherein each said rib on said unitary rear fence section plurality of partial fence elements extends from the inner portion of the associated edge face.

7. The molded plastic fence assembly of claim 6 further comprising a coupling device structured to couple said unitary front fence section and said unitary rear fence section.

8. The molded plastic fence assembly of claim 7 wherein:

said coupling device includes a coupling device first component and a coupling device second component;

said coupling device first component extending from at least one of said unitary front fence section plurality of partial fence elements planar member inner side; and said coupling device second component extending from at least one of said unitary rear fence section plurality of partial fence elements planar member inner side.

9. The molded plastic fence assembly of claim 8 wherein said coupling device includes an adhesive, said adhesive disposed in said collar prior to the insertion of said peg, whereby said peg is bonded to said collar.

10. The molded plastic fence assembly of claim 7 wherein said coupling device includes an adhesive, said adhesive disposed between said unitary front fence section and said unitary rear fence section whereby said unitary front fence section and said unitary rear fence section are bonded together.

11. The molded plastic fence assembly of claim 1 wherein said unitary front fence section further includes a coupling device structured to couple said unitary front fence section and said unitary rear fence section.

12. The molded plastic fence assembly of claim 11 wherein:

each said planar member in said unitary front fence section plurality of partial fence elements has a forward side and inner side;

each said planar member in said unitary rear fence section plurality of partial fence elements has a back side and inner side;

said coupling device includes a coupling device first component and a coupling device second component;

said coupling device first component extending from at least one of said unitary front fence section plurality of partial fence elements planar member inner side; and said coupling device second component extending from at least one of said unitary rear fence section plurality of partial fence elements planar member inner side.

13. The molded plastic fence assembly of claim 12 wherein said coupling device includes an adhesive, said adhesive disposed in said collar prior to the insertion of said peg, whereby said peg is bonded to said collar.

14. The molded plastic fence assembly of claim 11 wherein said coupling device includes an adhesive, said adhesive disposed between said unitary front fence section and said unitary rear fence section whereby said unitary front fence section and said unitary rear fence section are bonded together.

* * * * *

UNITED STATES PATENT AND TRADEMARK OFFICE

CERTIFICATE OF CORRECTION

PATENT NO. : 7,726,633 B2
APPLICATION NO. : 12/049409
DATED : June 1, 2010
INVENTOR(S) : John H. Cook et al.

It is certified that error appears in the above-identified patent and that said Letters Patent is hereby corrected as shown below:

Column 2, line 14, "sections coupled" should read --sections are coupled--.
Column 2, line 51, "side 24, a plurality" should read --side 24, and a plurality--.
Column 6, Claim 5, line 12, delete "wherein".
Column 6, Claim 6, line 21, delete "wherein".

Signed and Sealed this

Thirtieth Day of November, 2010

David J. Kappos

David J. Kappos
*Director of the United States Patent and Trademark Office*